US006901686B2

(12) United States Patent
Hayes

(10) Patent No.: US 6,901,686 B2
(45) Date of Patent: Jun. 7, 2005

(54) DEVICES AND SYSTEMS FOR DYNAMIC FOOT SUPPORT

(76) Inventor: Riccardo W. Hayes, 7333 Dartmouth, St. Louis, MO (US) 63130

( * ) Notice: Subject to any disclaimer, the term of this patent is extended or adjusted under 35 U.S.C. 154(b) by 118 days.

(21) Appl. No.: 10/314,368

(22) Filed: Dec. 9, 2002

(65) Prior Publication Data

US 2003/0126761 A1 Jul. 10, 2003

Related U.S. Application Data

(60) Provisional application No. 60/336,679, filed on Dec. 7, 2001.

(51) Int. Cl.[7] ..... A43B 13/28
(52) U.S. Cl. ..... 36/27; 36/115; 36/28
(58) Field of Search ..... 36/27, 7.8, 115; 280/11.225, 11.12

(56) References Cited

U.S. PATENT DOCUMENTS

| | | | | | |
|---|---|---|---|---|---|
| 1,587,749 | A | * | 6/1926 | Bierly | 482/80 |
| 2,442,026 | A | * | 5/1948 | Thompson, Jr. | 36/2.6 |
| 2,599,970 | A | | 6/1952 | Barrons | |
| 3,464,126 | A | | 9/1969 | Sarkissian | |
| 3,886,674 | A | | 6/1975 | Pavia | |
| 4,416,072 | A | | 11/1983 | Sarkissian | |
| 4,670,996 | A | | 6/1987 | Dill | |
| 4,736,530 | A | * | 4/1988 | Lakic et al. | 36/2.6 |
| 4,910,885 | A | | 3/1990 | Hsieh | |
| 5,187,883 | A | | 2/1993 | Penney | |
| 5,203,095 | A | | 4/1993 | Allen | |
| 5,282,325 | A | * | 2/1994 | Beyl | 36/27 |
| 5,309,651 | A | | 5/1994 | Handel | |
| 5,347,730 | A | | 9/1994 | Rodriguez Colon | |
| 5,410,820 | A | | 5/1995 | Goodman | |
| 5,435,079 | A | | 7/1995 | Gallegos | |
| 5,503,413 | A | * | 4/1996 | Belogour | 280/11.225 |
| 5,596,819 | A | | 1/1997 | Goldston et al. | |
| 5,797,198 | A | | 8/1998 | Pomerantz | |
| 6,029,374 | A | * | 2/2000 | Herr et al. | 36/27 |
| 6,079,126 | A | | 6/2000 | Olszewski | |
| 6,115,942 | A | | 9/2000 | Paradis | |
| 6,131,309 | A | | 10/2000 | Walsh | |
| 6,247,249 | B1 | * | 6/2001 | Lindqvist | 36/28 |
| D446,923 | S | | 8/2001 | McCourt | |
| D447,330 | S | | 9/2001 | McCourt | |
| 6,282,814 | B1 | | 9/2001 | Krafsur et al. | |
| D450,437 | S | | 11/2001 | Simpson et al. | |
| 6,393,731 | B1 | | 5/2002 | Moua et al. | |
| 6,405,455 | B1 | * | 6/2002 | Walsh | 36/28 |
| 6,568,102 | B1 | * | 5/2003 | Healy et al. | 36/28 |
| 6,592,131 | B1 | * | 7/2003 | Bai | 280/11.224 |
| 6,662,471 | B2 | * | 12/2003 | Meschan | 36/27 |

FOREIGN PATENT DOCUMENTS

| | | |
|---|---|---|
| GB | 2 200 030 | 7/1988 |

OTHER PUBLICATIONS

International Search Report, Apr. 29, 2003.
Z–Coil® Shoes for Pain Relief (www.zcoil.com).

* cited by examiner

*Primary Examiner*—Ted Kavanaugh
(74) *Attorney, Agent, or Firm*—Moazzam & Latimer LLP

(57) ABSTRACT

Devices and systems for providing dynamic foot support to a user are described. A device includes a heel support shelf, a foot support shelf, and a dampening device that allows relative motion of the heel support shelf with respect to the foot support shelf. When a wearer has on footwear that includes such a device, his or her foot is bent and flexed within the footwear during natural walking motion, thereby promoting blood flow, preventing stress, increasing comfort and reducing pain.

9 Claims, 17 Drawing Sheets

626
627
628
629
631
632
620
604
640
603
625
602
601
600
610

829
831
833

820
804
840

803
827

826
828
804
840
803
825
810
802
820
801
800

DEVICES AND SYSTEMS FOR DYNAMIC FOOT SUPPORT

This application claims the benefit of U.S. Provisional Application No. 60/336,679, filed Dec. 7, 2001, which is incorporated by reference herein in its entirety.

BACKGROUND

1. Field of the Invention

The present invention relates to foot supports. More specifically, the present invention relates to foot supports that are moveable in relation to applied stresses from a foot.

2. Background of the Invention

Seeking the right level of comfort in selecting footwear has typically been a laborious task. The constant stresses and strains that feet must endure during a typical day of motion are mitigated in large part by the type of footwear that is worn. Another important factor in selecting desired footwear is fashion. Too often, comfort and fashion are balanced against one another to select the proper footwear. For example, a typical problem with wearing high heel shoes is that they are highly uncomfortable to wear for prolonged periods of time, despite the desirability for their attractive look and fashion appeal.

Unfortunately, the problem of foot discomfort in wearing certain types of footwear still exists. For example, there is still no feasible solution to the problem of foot discomfort caused by high heel footwear. Such high heel footwear causes undue pain for the feet and discomfort for the calves and legs when worn for more than a short period of time. Moreover, wearers must endure such pain and discomfort for the sake of fashion given the lack of any alternatives. Thus, comfort and safety are too often sacrificed for the sake of fashion, resulting in pain and possible injury by the end of a day.

SUMMARY OF THE INVENTION

The present invention is a dynamic mechanism that is incorporated into footwear enabling comfortable, flexible, and adjustable fit. The mechanism has moving components that move in the direction of generated foot stresses thereby cushioning the foot as it goes through natural moving motion. Furthermore, the mechanism is adjustable for differing reactionary tensions and heights, thereby decreasing the stresses and strains that are imparted on the foot during natural motion. The present invention is designed to provide safety and comfort while maintaining a desired fashion sense. Furthermore, the mechanism also provides a "spring" in the step of a user wearing footwear incorporating such a mechanism. High heel shoes fitted with such dynamic foot support mechanisms are more comfortable for the wearer, decrease the pain and discomfort associated with standard rigid high heel shoes, and decrease the risks associated with injuries from walking on rigid high heel shoes.

As used herein and throughout this disclosure, the term "footwear" means any product that is reversibly attachable to one or more feet. Such footwear typically includes a strap, buckle, lace, VELCRO (hook and loop fasteners), or other similar means to reversibly secure the footwear onto the foot and to maintain the foot in a substantially stable position relative to the footwear. Exemplary footwear includes, but is not limited to, shoes, sandals, boots, inline skates, roller skates, ice skates, ski boots, snowboarding boots, and the like. Other types of footwear are also possible.

As used herein and throughout this disclosure, the term "dampening device" means a mechanism that decreases the stresses that are applied onto the mechanism. In other words, a dampening device cushions an applied stress and internally absorbs a portion of it. Exemplary dampening devices include, but are not limited to, shock absorbers, pistons, springs, viscous materials, viscoelastic materials, cushion materials, or the like. Other materials may be used in a dampening device as long as such materials enable a force to be decreased when such a force is applied to a given pre-determined length of material in the dampening device.

An exemplary embodiment of the present invention is dynamic foot support device. The device includes a heel support shelf for supporting a heel portion of a foot, a foot support shelf for supporting a distal portion of a foot, and a dampening device in communication with the heel support shelf and the foot support shelf; wherein the dampening device allows a relative motion of the heel support shelf with respect to the foot support shelf when a force is applied to the heel support shelf.

Another exemplary embodiment of the present invention is a device for dynamic foot support. The device includes a heel support shelf for supporting a heel portion of a foot, a foot support shelf for supporting a foot, and means for allowing motion of the heel support shelf with respect to the foot support shelf when a force is applied to the heel support shelf.

Yet another exemplary embodiment of the present invention is a system for dynamic foot support. The system includes a footwear for accommodating a foot, and a dynamic foot support platform incorporated within the footwear. The dynamic foot support platform includes a heel support shelf for supporting a heel portion of a foot, a foot support shelf for supporting a foot, and a dampening device in communication with the heel support shelf and the foot support shelf, wherein the dampening device allows relative motion of the heel support shelf to the foot support shelf when a force is applied to the heel support shelf.

DETAILED DESCRIPTION OF PREFERRED EMBODIMENTS

An exemplary device for dynamic foot support includes one or more dampening devices that are used to decrease the magnitude of stresses that are imposed on a foot during motion. Such a dampening device may be positioned at or near a heel area of footwear to provide dynamic motion to the bottom side of feet. Footwear with high heels may use such dampening devices to maintain a relative height advantage while at the same time providing dynamic motion to the feet to prevent stresses imposed on the feet from high heels. Additionally, such footwear also provides a "spring" to the step of a user as the dampening device provides a reactive force that slightly propels the bottom of a foot. Consequently, runners or fast walkers can also benefit from the comfort of the present invention. Such dynamic foot support may be incorporated within any type of footwear to provide the wearer a dynamic response mechanism that decreases stresses imposed on the feet, decreases possible injuries, increases comfort and promotes health and safety. Optionally, the devices according to the present invention may be retroactively fit into footwear.

Figure 1:
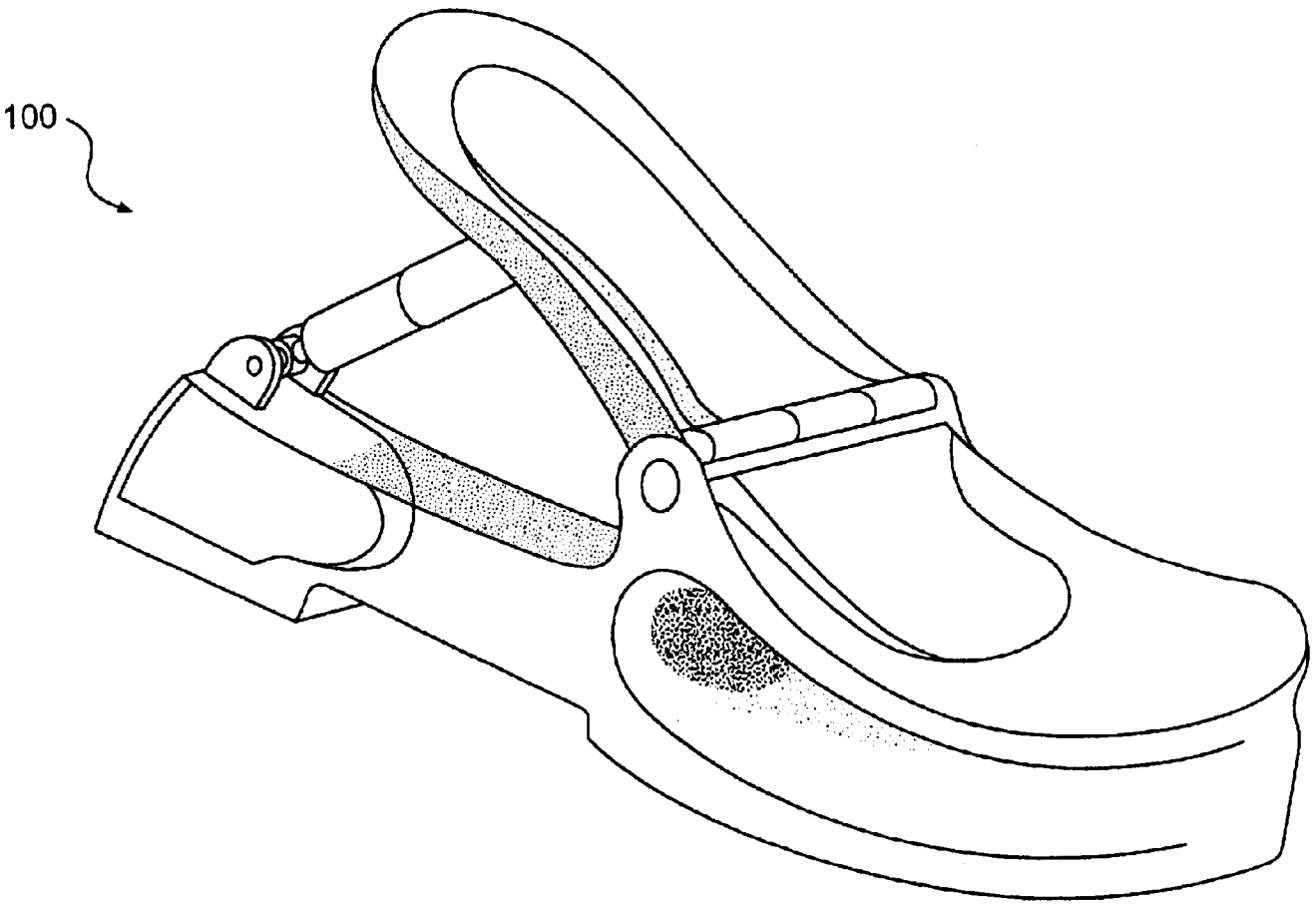
FIG. 1 shows an exemplary embodiment of the dynamic foot support platform of the present invention.
Figure 2B:
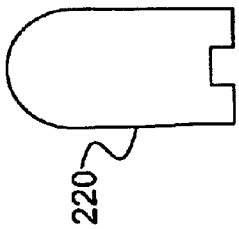
FIG. 2*b* shows a top view of a heel support shelf of the exemplary dynamic foot support platform of FIG. 2*a*.
Figure 2C:
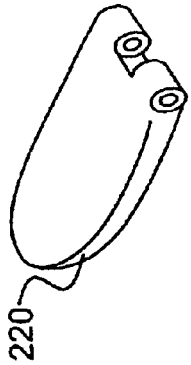
FIG. 2*c* shows a perspective view of a heel support shelf of the exemplary dynamic foot support platform of FIG. 2*a*.
Figure 2D:
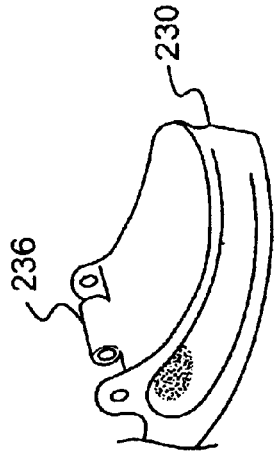
FIG. 2*d* shows a perspective view of a front portion of a foot support shelf of the exemplary dynamic foot support platform of FIG. 2*a*.
Figure 2A:
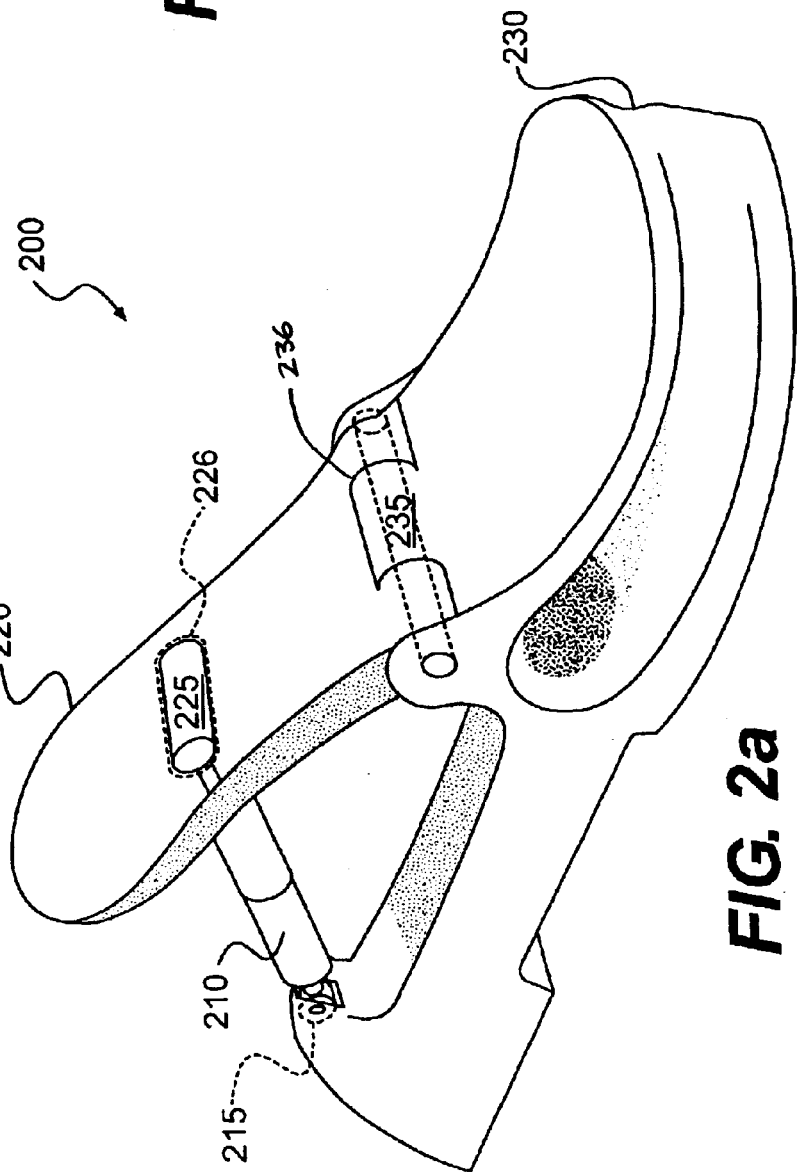
FIG. 2*a* shows various components of an exemplary embodiment of the dynamic foot support platform of the present invention.

FIG. 1 shows an exemplary embodiment of a dynamic foot support platform 100 according to the present invention. Although dynamic foot support platform 100 is presented in a given shape with particular features, the present invention is not limited to such an exemplary embodiment. Other dynamic foot support platform embodiments are possible and are within the scope of the present invention. Furthermore, footwear that includes such dynamic foot support platforms is also within the scope of the present invention.

An exemplary embodiment of a dynamic foot support platform according to an embodiment of the present invention is illustrated in FIG. 2. A dynamic foot support platform 200 includes a heel support shelf 220 (FIGS. 2*b* and 2*c*) for cradling a heel end of the foot, a foot support shelf 230 (FIG. 2*d*) for cradling a bottom side of a foot, more particularly, the distal toes-end of the foot, and a dampening device 210 for absorbing downward pressure on heel support shelf 220. Heel support shelf 220 typically is conformed to support a heel of a foot. Foot support shelf 230 typically is conformed to support or cradle parts of the foot distal to the heel. Dampening device 210 adjusts in length to conform to different pressures exerted by a foot on platform 200.

Furthermore, dampening device 210 may be easily replaced in a given foot support platform so as to give the wearer more choices in dynamic reactivity of the footwear. Connectors that secure dampening device 210 within a foot support platform 200 may be easily engaged or disengaged to allow the user a quick replacement of the dampening device 210. Different dampening devices 210 may provide different elasticity and reactive forces, thereby providing a range of comfort to a given wearer. The dynamic function of dampening device 210 within dynamic foot support platform 200 is explained in more detail below.

Dampening device 210 enables heel support shelf 220 to adjust in position with respect to foot support shelf 230 by, for example, promoting rotation about a given rotating pivot area. Such a rotating pivot may be, for example, a pin 235 within a pin-accommodating groove 236. Other configurations for the pivot area are possible.

Dampening device 210 links heel support shelf 220 with foot support shelf 230 via one or more connectors. An exemplary connector used to connect dampening device 210 to heel support shelf 220 is tubular snap-fit structure 225, which is on an end of dampening device 210. Tubular structure 225 is accommodated into tubular structure accommodating area 226 on heel support shelf 220. On the other end of dampening device 210 is another system of connectors 215 that securely connect dampening device 210 to a heel end of foot support shelf 230. Other connector systems can be used. Such other connector systems are described below.

When a pressure is exerted on platform 200 as a result of, for example, a downward motion of a foot during walking, dampening device 210 may adjust in length. Such changes in length of dampening device 210 result in changes of the relative position of heel support shelf 220 with respect to foot support shelf 230 before and after the application of such a pressure. Conversely, when the same pressure is reduced or withdrawn from the platform 200, then dampening device 210 increases in length, thereby again changing the relative position of heel support shelf 220 with respect to foot support shelf 230. Such changes in the length of dampening device 210 results in a cushioning of the step for the wearer, which is more comfortable, safer, and less painful for the wearer. The same principles apply to all of the exemplary embodiments shown here.

Figure 3:
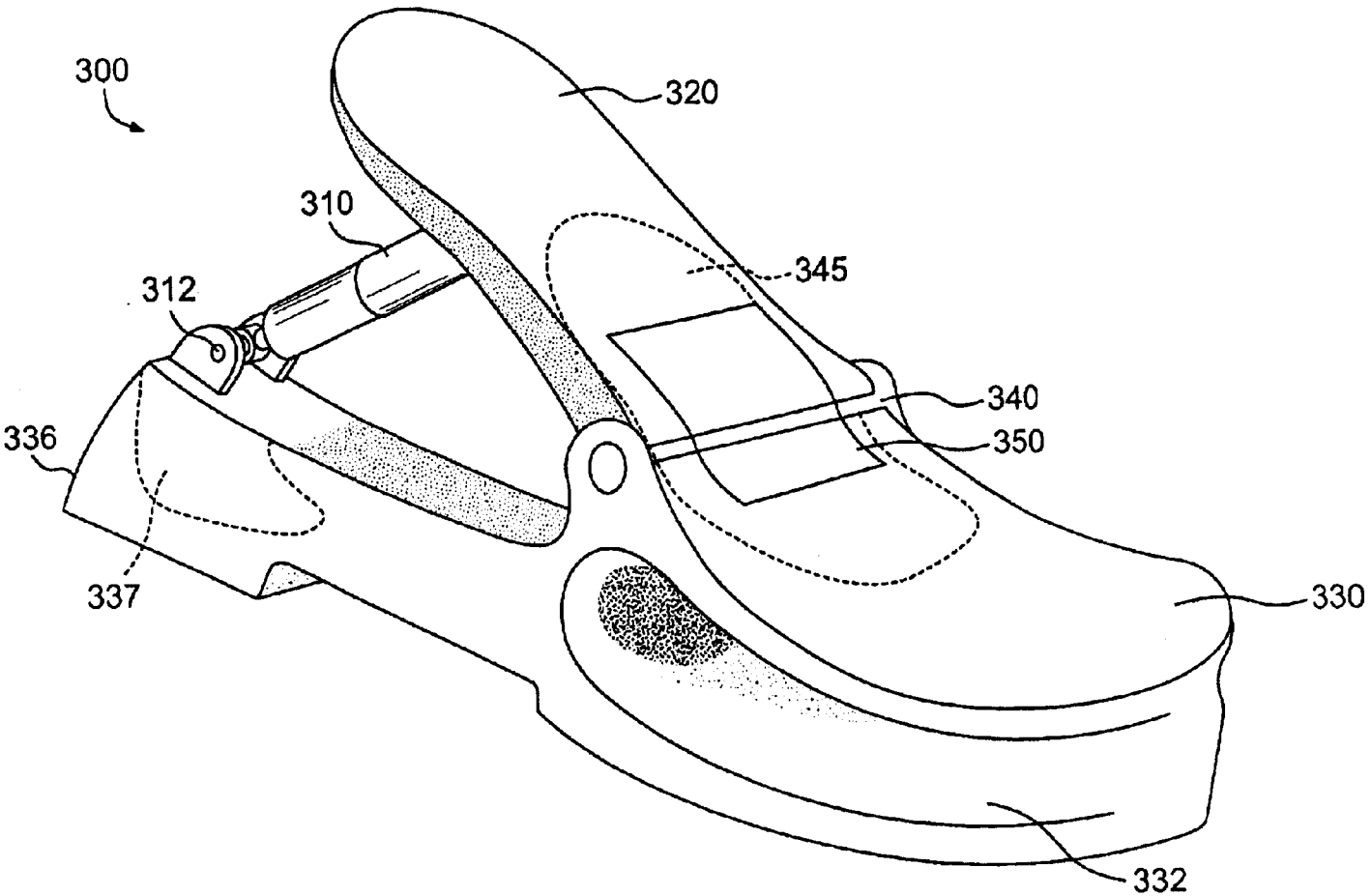
FIG. 3 shows a dynamic foot support platform according to another exemplary embodiment of the present invention.

FIG. 3 illustrates a dynamic foot support platform according to another exemplary embodiment of the present invention. A dynamic foot support platform 300 includes a dampening device 310, a heel support shelf 320, and a foot support shelf 330. Dampening device 310 is connected to a heel 336 of foot support shelf 330 via a connector, which may be, for example, a pivot and bracket configuration 312. An interior bracket support 337 may be used to anchor the bracket of the bracket configuration 312 securely within foot support shelf 330. Interior bracket support 337 may be, for example, hard plastic, metal, or suitable material that can act as an anchor within foot support shelf 330. A connector, such as a hinge 340, links heel support shelf 320 with foot support shelf 330.

Foot support shelf 330 may be in the shape of an elongated, substantially planar surface that supports a user's foot, extending from a toe area to a heel area. Alternatively, foot support shelf 330 may be non-uniform across its length and have grooves or ridges 332 along its body for functional or stylish purposes. Other shapes, for example cut outs or geometrical designs, can be used. A layer of protective material 350 may be positioned atop of hinge 340 to promote the durability of hinge 340. Additionally, the layer of protective material 350 protects the bottom of a foot from getting injured by contact with the moving mechanism of hinge 340. Layer of protective material 350 may be, for example, a pad, a tape, a sponge, or other suitable protective material. Furthermore, an interior layer of support material 345 for hinge 340 promotes the flexibility of the hinge mechanism while maintaining structural integrity. For example, the interior layer of support material 345 may be substantially stiff but with enough flexibility to allow the motion of heel support shelf 320 when an application is applied thereon.

Figure 4:
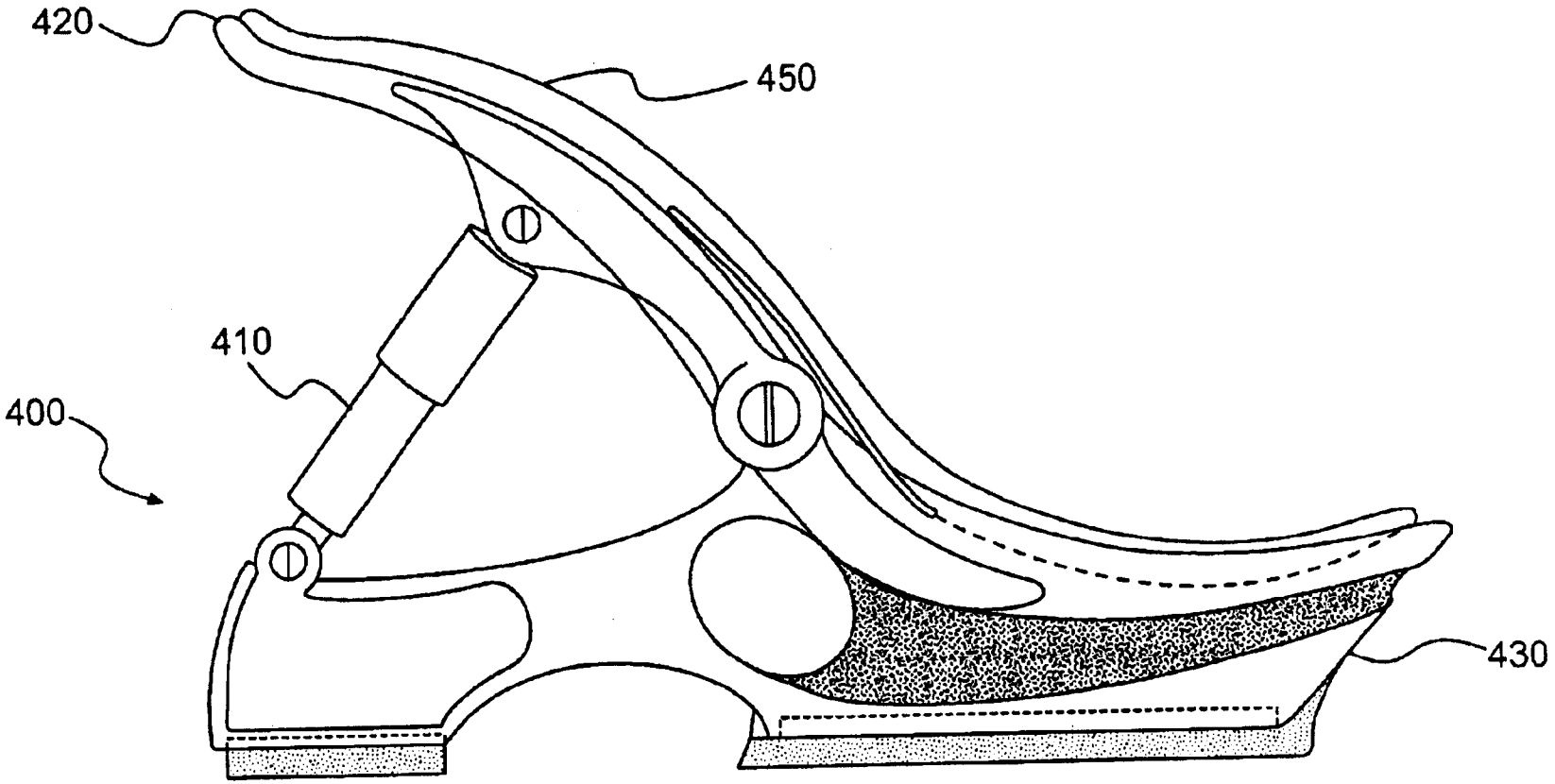
FIG. 4 shows a side view of a dynamic foot support platform according to another exemplary embodiment of the present invention.

FIG. 4 illustrates a dynamic a foot support platform 400 according to another exemplary embodiment of the present invention. Dynamic foot support platform 400 includes a dampening device 410, a heel support shelf 420 and foot support shelf 430. Additionally, a layer of lining 450 is positioned on top of the heel support shelf 420 and foot support shelf 430 such that the layer of lining 450 spans across the entire length of the underside of a foot, from a heel area to a toe area. Such a layer of lining 450 may be composed of, for example, a cushioned rubber, leather, foam, fabric, rubber, or similar material. Other suitable materials are possible and within the scope of this invention. A portion of the layer of lining 450 is recessed into the foot platform 400 to secure the lining within the heel support shelf 420 and foot support shelf 430.

Figure 5:
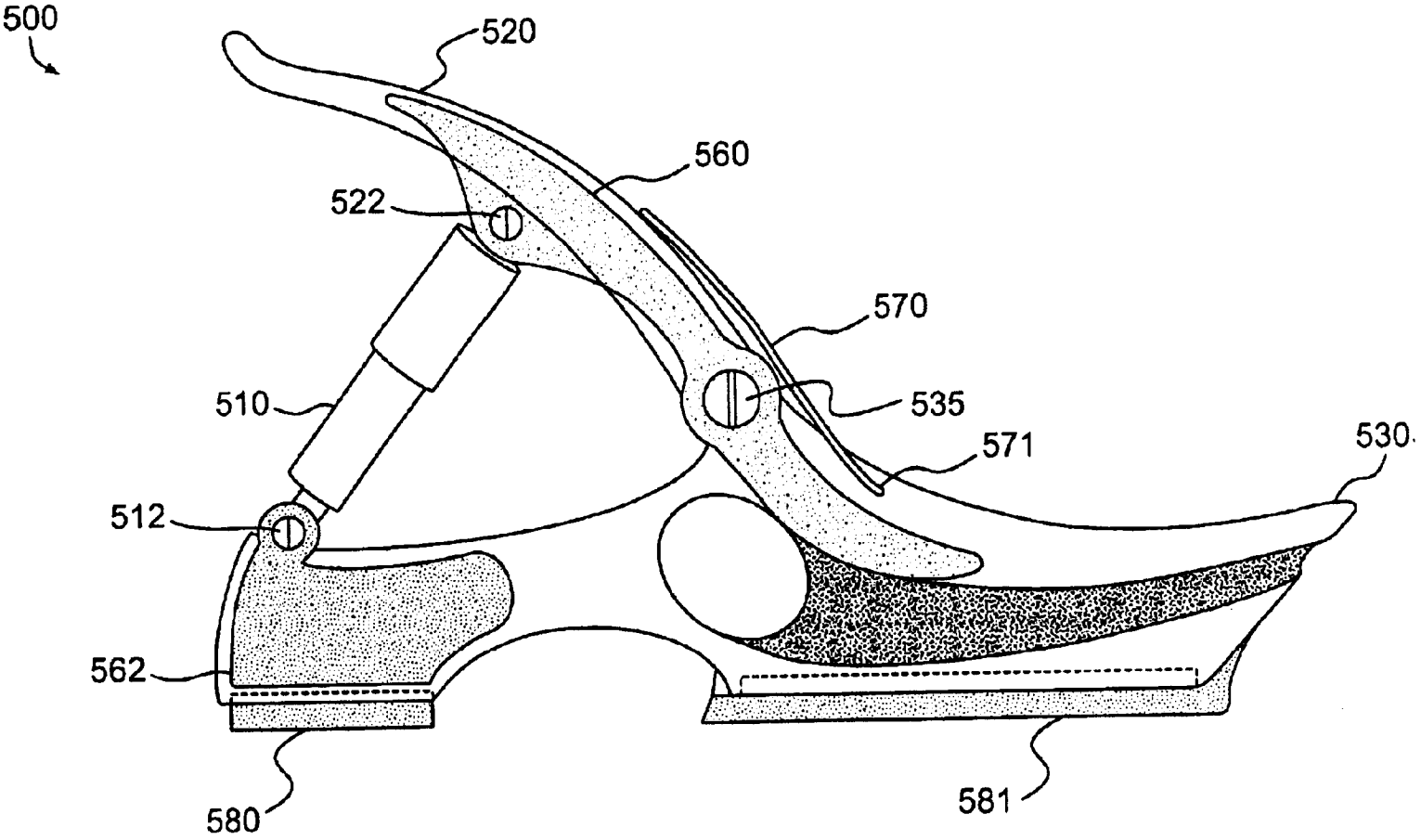
FIG. 5 shows a side view of a dynamic foot support platform according to yet another exemplary embodiment of the present invention.

FIG. 5 illustrates another exemplary embodiment of the present invention. A dynamic foot support platform 500 includes a dampening device 510, a heel support shelf 520 and a foot support shelf 530. Dampening device 510 is linked to heel support shelf 520 and foot support shelf 530 through connectors 522 and 512, respectively. An internal heel support 562 anchors part of connector 512 to foot support shelf 530. Internal heel support 562 may be, for example, hard plastic, metal, or suitable material that can act as an anchor within foot support shelf 530.

A heel pad 580 and a sole pad 581 are used to further cushion each step as a user walks with footwear that incorporates foot support platform 500. Heel pad 580 and sole pad 581 may be composed of, for example, rubber, plastic, metal, or other suitable material or combinations thereof used for heel/sole pads.

All parts of dynamic foot support platform 500 other than heel pad 580 and sole pad 581 may be composed of durable, lightweight materials, such as, for example, carbon fiber, urethane, plastics, lightweight alloy metals, including aluminum, steel, and titanium, other suitable material, or combinations thereof. These materials may be used for any of the other embodiments shown and described herein. Other suitable materials are possible, such as hollow hardened steel. Additionally, each component of shoe platform 500, other than dampening device 510, may be wrapped by carbon fiber for increased strength and durability. A technique of integrating carbon fiber and metal in the manufacturing process may be the well known Bladder Mold Method. In such a method, a carbon fiber may be wrapped around all of the non-critical areas of the metal, the critical areas being the attachment points.

Connectors 512 and 522 are shown in FIG. 5 as threaded retainer pins as an example. Other types of connectors including snap fit connectors, hook connectors, hinges, screw-type rods, or suitable connectors may be used. Rotating pivot 535 is shown as a rod rotating in a rod-accommodating slot. Other types of rotating mechanisms can be used, including an indented, perforated, or crumbled region of hard plastic that allows motion of heel support shelf 520 with respect to foot support shelf 530 about rotating pivot 535 without sacrificing structural stability. Optionally, the material properties of a given sheet of material may be altered at a particular region or line to enable increased flexibility in such an altered region or line resulting in creation of, for example, a pivoting region.

A protective cover 570 is positioned across a region extending between heel support shelf 520 and foot support shelf 530. Protective cover 570 prevents rotating pivot 535 from injuring the bottom of a user's foot that is positioned atop the foot platform 500. A front end of protective cover 570 may be secured in a protective cover slot 571 in foot support shelf 530 that allows freedom of movement of protective cover 570 independent of any motion of heel support shelf 520 with respect to foot support shelf 530. Alternatively, protective cover 570 may be glued or otherwise attached to the surfaces of heel support shelf 520 and foot support shelf 530. It would be apparent to those skilled in the art that other methods of attachment can be used.

Figures 6A, 6B, 6C, 6D, 6E, 6F:
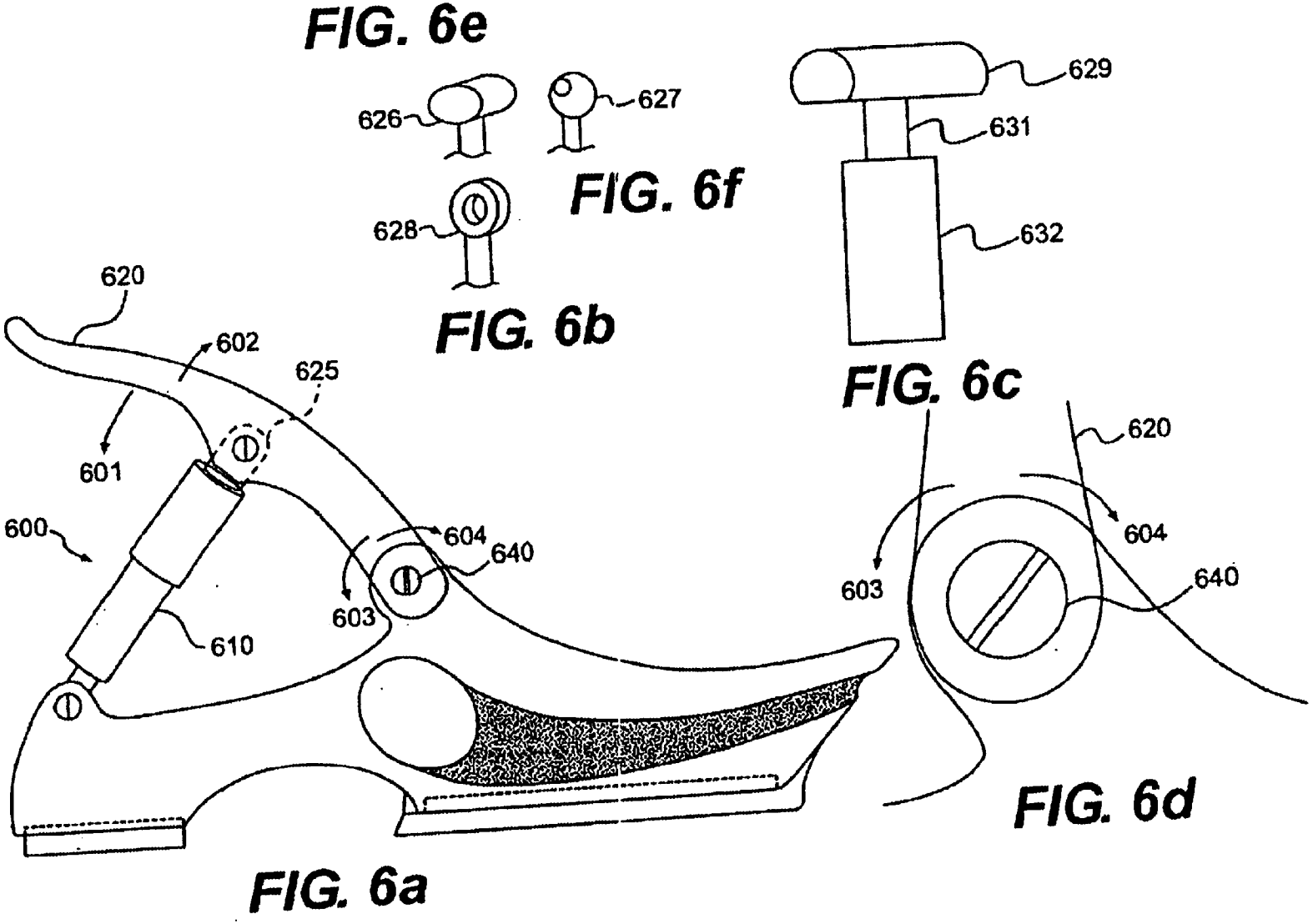
FIG. 6*a* shows a side view of a dynamic foot support platform according to another exemplary embodiment of the present invention.
FIG. 6*b* shows an exemplary connector that is used for the dynamic foot support platform in FIG. 6*a*.
FIG. 6*c* shows an exemplary connector used to connect various components of the dynamic foot support platform in FIG. 6*a*.
FIG. 6*d* shows a side view of a pivot area of the dynamic foot support platform of FIG. 6*a*.
FIG. 6*e* shows an exemplary connector that is used for the dynamic foot support platform in FIG. 6*a*.
FIG. 6*f* shows an exemplary connector that is used for the dynamic foot support platform in FIG. 6*a*.

FIG. 6 illustrates an embodiment of a dynamic foot support platform according to another embodiment of the present invention. As dynamic foot support platform 600 is used, such as during walking, downward forces of the wearer's body through the feet are exerted onto heel support shelf 620, resulting in relative downward and upward motions of heel support shelf 620. All such downward and upward motions of heel support shelf 620 are possible by rotation of an end of heel support shelf 620 in an arc about rotating pivot 640. This mechanism is also present in the other embodiments shown and described herein.

In use, a downward force on foot platform 600 results in a downward motion of heel support shelf 620 in the direction of arrow 601 and a rotation about pivot 640 in the arc direction of arrow 603. Any decrease in downward force on foot platform 600 results in an upward motion of heel support shelf 620 in the direction of arrow 602 and a rotation about pivot 640 in the arc direction of arrow 604.

A connector 625 is a standard metal pin as an example. It would be apparent to those skilled in the art that other types of connectors can be used. Connectors 626, 627, 628, and 629 shown in FIGS. 6*b*, 6*c*, 6*e*, and 6*f*, respectively, are other examples of connectors. Connectors 626 and 627 are press fit connectors that are pressed into a slot (not shown) on the bottom side of heel support shelf 620 to create a tight fit. Different geometries may be used for press fit connectors, such as, for example, a cylindrical head 626 or a spherical head 627. Another connector 628 that may be used is a head with a slot for a pin (not shown), which would be positioned on the bottom side of heel support shelf 620.

Another connector 629 is in the shape of an incomplete cylinder and is an integral component of dampening device 610. This connector 629 may be snapped or pressed into a slot (not shown) in heel support shelf 620 and is connected to body 632 of dampening device 610 through a neck region 631. The widened head of connector 629 provides increased surface area for distribution of downward forces on dampening device 610, thereby decreasing the stress at any given point on the top surface of connector 629. This is one method that strengthens the connection between heel support shelf 620 and dampening device 610. Other strengthening methods are also possible.

Figure 7:
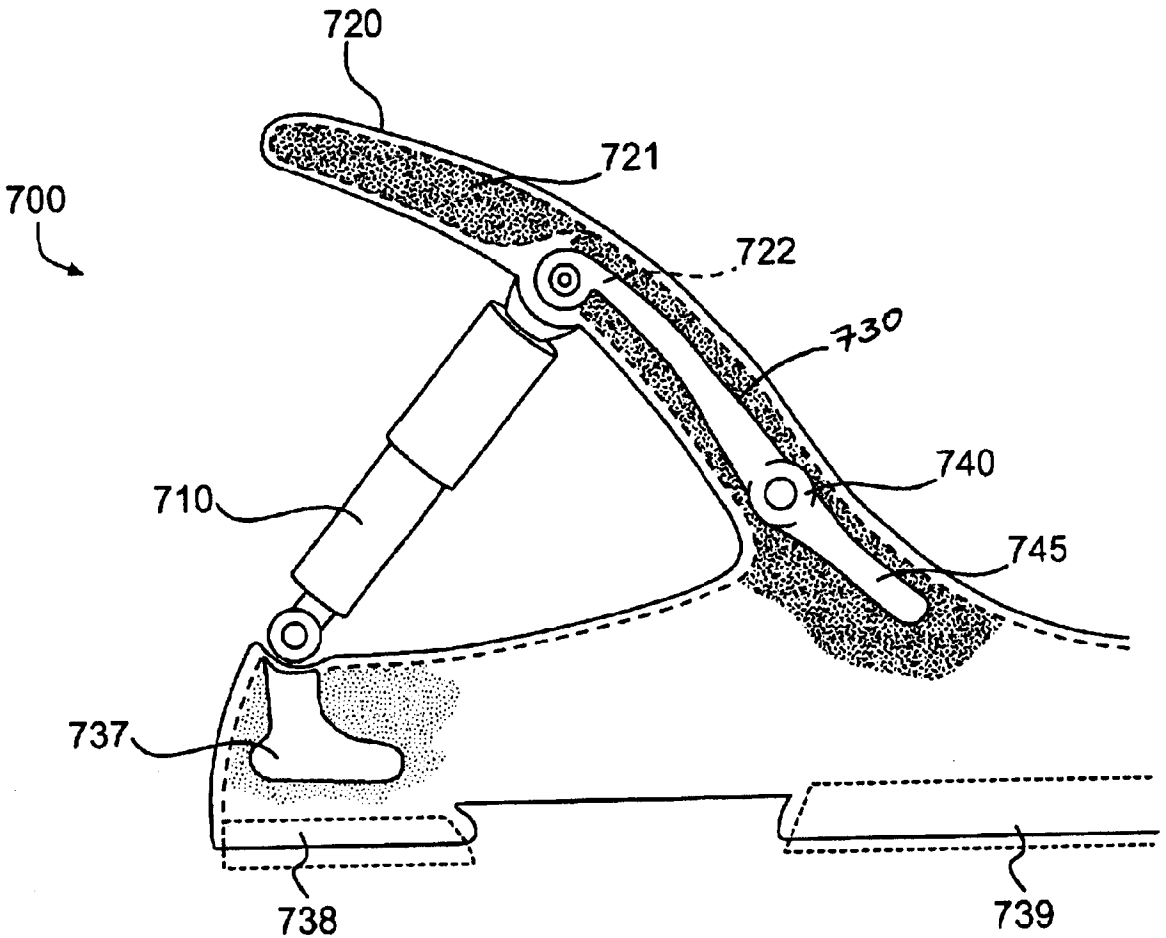
FIG. 7 shows a partial side view of a foot support platform according to another exemplary embodiment of the present invention.

FIG. 7 illustrates a cutaway partial side view of a dynamic foot support platform according to another exemplary embodiment of the present invention. A dynamic foot support platform 700 has a heel support shelf 720 that includes an internal layer of material 721 that increases strength and durability while decreasing weight. Layer of material 721 may be, for example, a carbon fiber. Other types of material are possible. An inlaid heel 738 and sole 739 may be composed of materials that further promote dampening of each step. Such materials for heel 738 and sole 739 include, for example, rubber, plastic, metal, another suitable material, or combinations thereof.

Heel support shelf 720 also contains an interior support bracket 730. Interior support bracket 730 has an upper arm 722 that extends from a connector at a top portion of dampening device 710 to rotating pivot 740. A lower arm 745 further extends from rotating pivot 740 into foot support shelf. The combination of upper arm 722 and lower arm 745 strengthens the area around rotating pivot 740, thereby promoting the longevity of the rotating mechanism.

On the other end of dampening device 710 is an internal support bracket 737 that extends from a connector at a bottom portion of dampening device 710. This multiple system of support brackets positioned on each end of and in connection to dampening device 710 promotes an increase in structural stability of dynamic foot support platform 700 by giving an internal skeletal structure to the areas of the foot platform 700 where there will be stress created from a walking motion of the user. The increase in structural stability promotes durability of dynamic foot support platform 700, thereby increasing the life of footwear that incorporates it.

FIG. 8 illustrates a dynamic foot support platform 800 according to another embodiment of the present invention. As dynamic foot support platform 800 is put into use, such as during walking, downward forces of the body through the feet are exerted onto heel support shelf 820, resulting in downward and upward motions of heel support shelf 820. All such upward and downward motions of heel support shelf 820 are possible by rotation of an end of heel support shelf 820 in an arc about rotating pivot 840.

In use, a downward force on foot platform 800 results in a downward motion of heel support shelf 820 in the direction of arrow 801 and a rotation about pivot 840 in the arc direction of arrow 803. Any relative decrease in downward force on foot platform 800 results in an upward motion of heel support shelf 820 in the direction of arrow 802 and a rotation about pivot 840 in the arc direction of arrow 804.

Figures 8A, 8B, 8C, 8D, 8E, 8F:
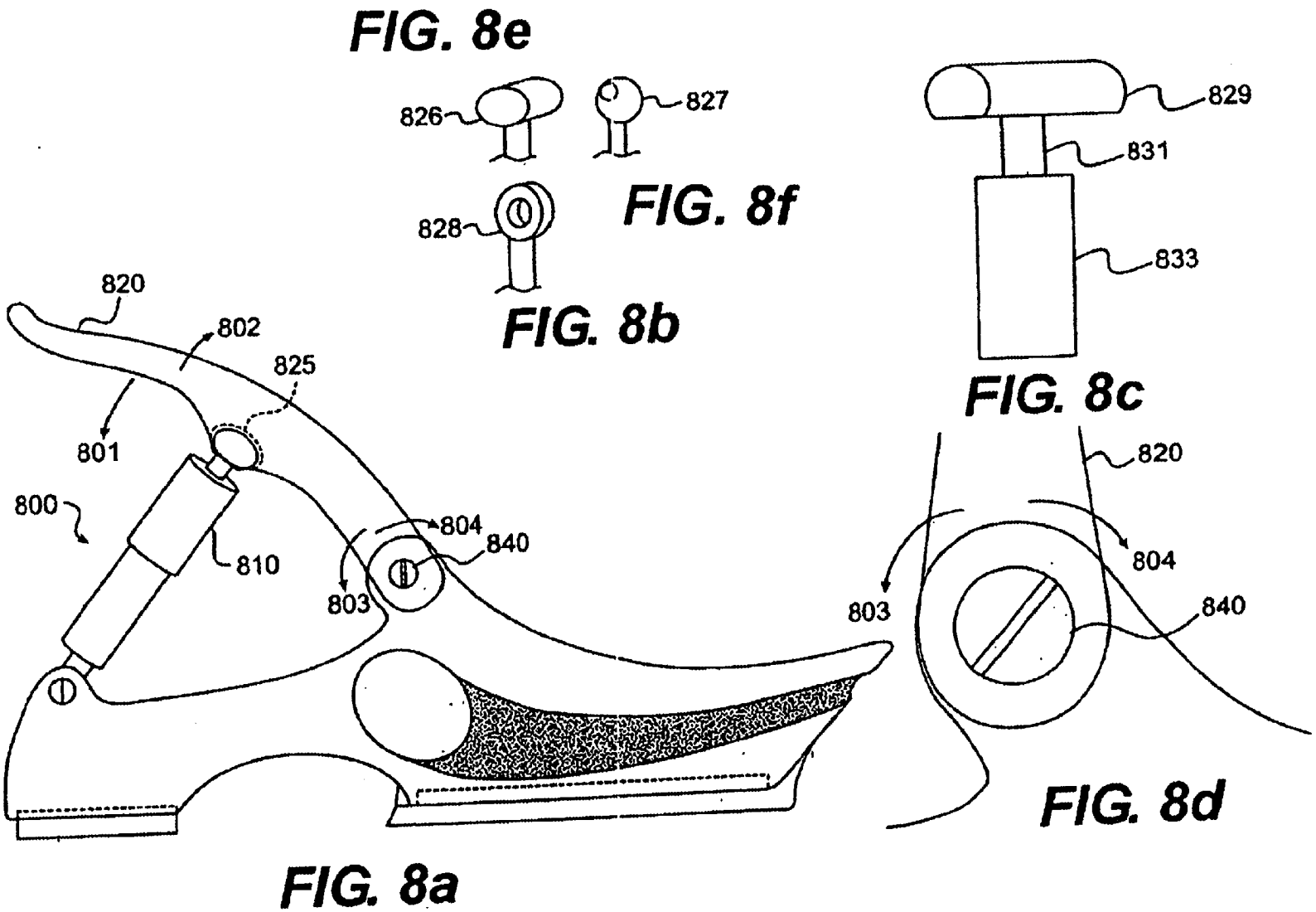
FIG. 8*a* shows a side view of a dynamic foot support platform according to an exemplary embodiment of the present invention.
FIG. 8*b* shows an exemplary connector for attaching the components of the foot support platform in FIG. 8*a*.
FIG. 8*c* shows an exemplary connector that is used to connect various components of the dynamic foot support platform of FIG. 8*a*.
FIG. 8*d* shows a side view of a pivot area of the dynamic foot support platform of FIG. 8*a*.
FIG. 8*e* shows an exemplary connector for attaching the components of the foot support platform in FIG. 8*a*.
FIG. 8*f* shows an exemplary connector for attaching the components of the foot support platform in FIG. 8*a*.

Connector 825 is shown in FIG. 8*a* as a press fit connector as an example. Other types of connectors are possible. Connectors 826, 827, 828, and 829, shown in FIGS. 8*b*, 8*c*, 8*e*, and 8*f*, respectively, are other examples of connectors that may be substituted for connector 825 in FIG. 8*a*. Connectors 826 and 827 are press fit connectors that are pressed into a slot on the bottom side of heel support shelf 820 to create a tight fit. Different geometries may be used for press fit connectors, such as, for example, a cylindrical head 826 or a spherical head 827.

Another connector 828 that may be used is a head with a slot for a pin (not shown), which would be positioned on the bottom side of heel support shelf 820. Another connector 829 is in the shape of an incomplete cylinder and is an integral component of dampening device 810. This connector 829 may be snapped or pressed into a slot in heel support shelf 820 and is connected to body 833 of dampening device 810 through a neck region 831. The widened head of connector 829 provides more surface area for distribution of downward forces on dampening device 810, thereby decreasing the stress at any given point on the top surface of connector 829.

Figure 9A:
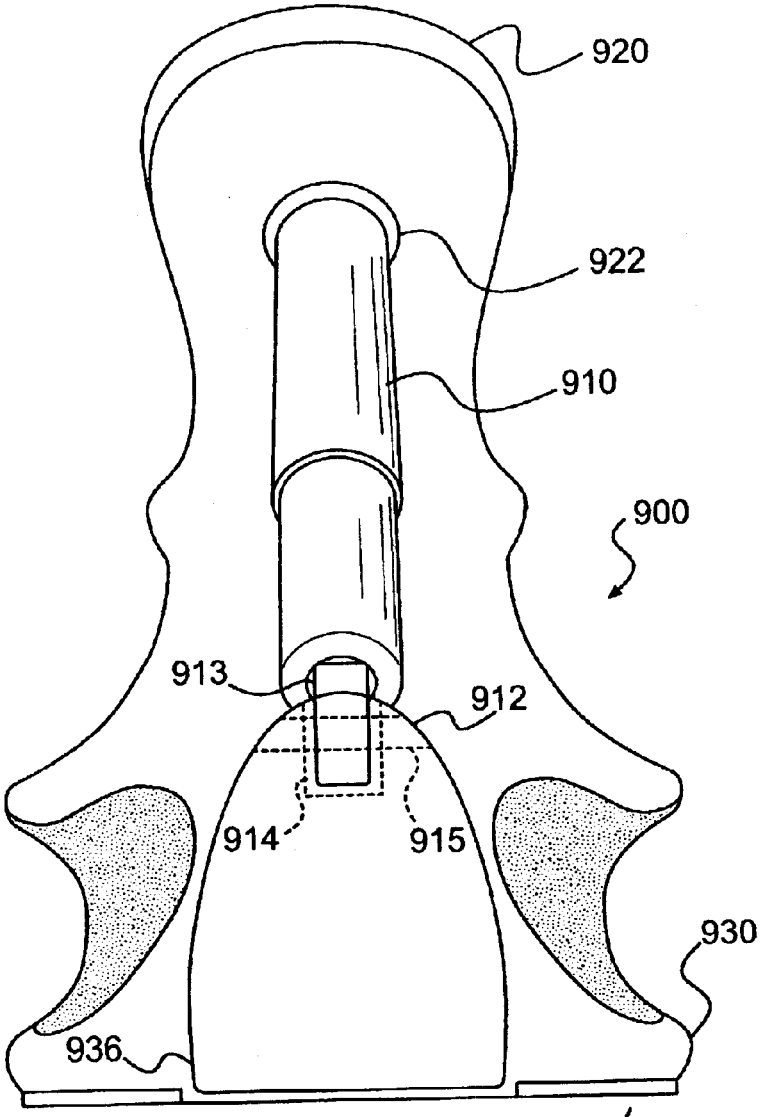
FIG. 9*a* shows a back view of a dynamic foot support platform according to an exemplary embodiment of the present invention.
Figure 9B:
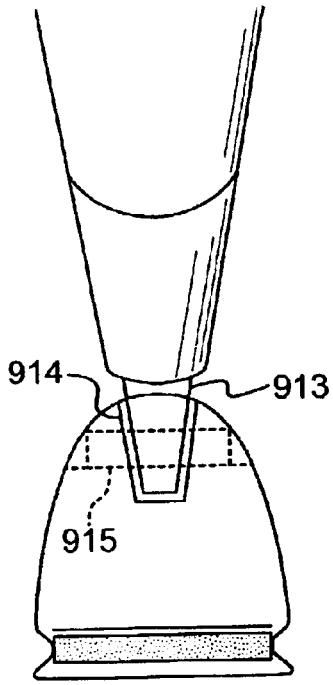
FIG. 9*b* shows the connectors of the foot support platform of FIG. 9*a*.
Figure 9C:
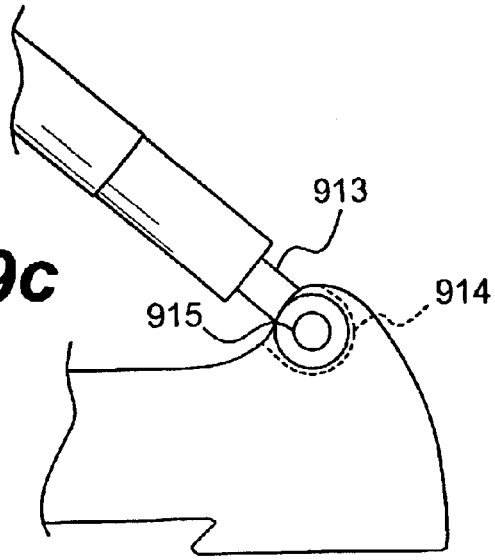
FIG. 9*c* shows a side view of the connectors of the foot support platform of FIG. 9*a*.

FIG. 9 illustrates a rear view of a dynamic foot support platform 900 according to another exemplary embodiment of the present invention. Dynamic foot support platform 900 includes a dampening device 910 in connection with a heel support shelf 920. In the embodiment illustrated, connector 922 is a tight-fit connector. It would be apparent to those skilled in the art that other connectors can be used. The other end of dampening device 910 includes a mount protrusion 913 that is accommodated into a mount protrusion slot 914 located in a heel portion 936 of foot support shelf 930. A retainer rod or pin may be positioned in retainer housing 915, which is perpendicular to mount protrusion 913. Any such rod or pin locks into and secures mount protrusion 913 with heel portion 936. The relationship between mount protrusion 913, mount protrusion accommodating slot 914, and retainer housing 915 is also shown in FIG. 9*b* from the opposite view of FIG. 9*a*, and in FIG. 9C from a side view of FIG. 9*a*. Other connections, protrusion, and mounting mechanisms are possible.

Figure 10:
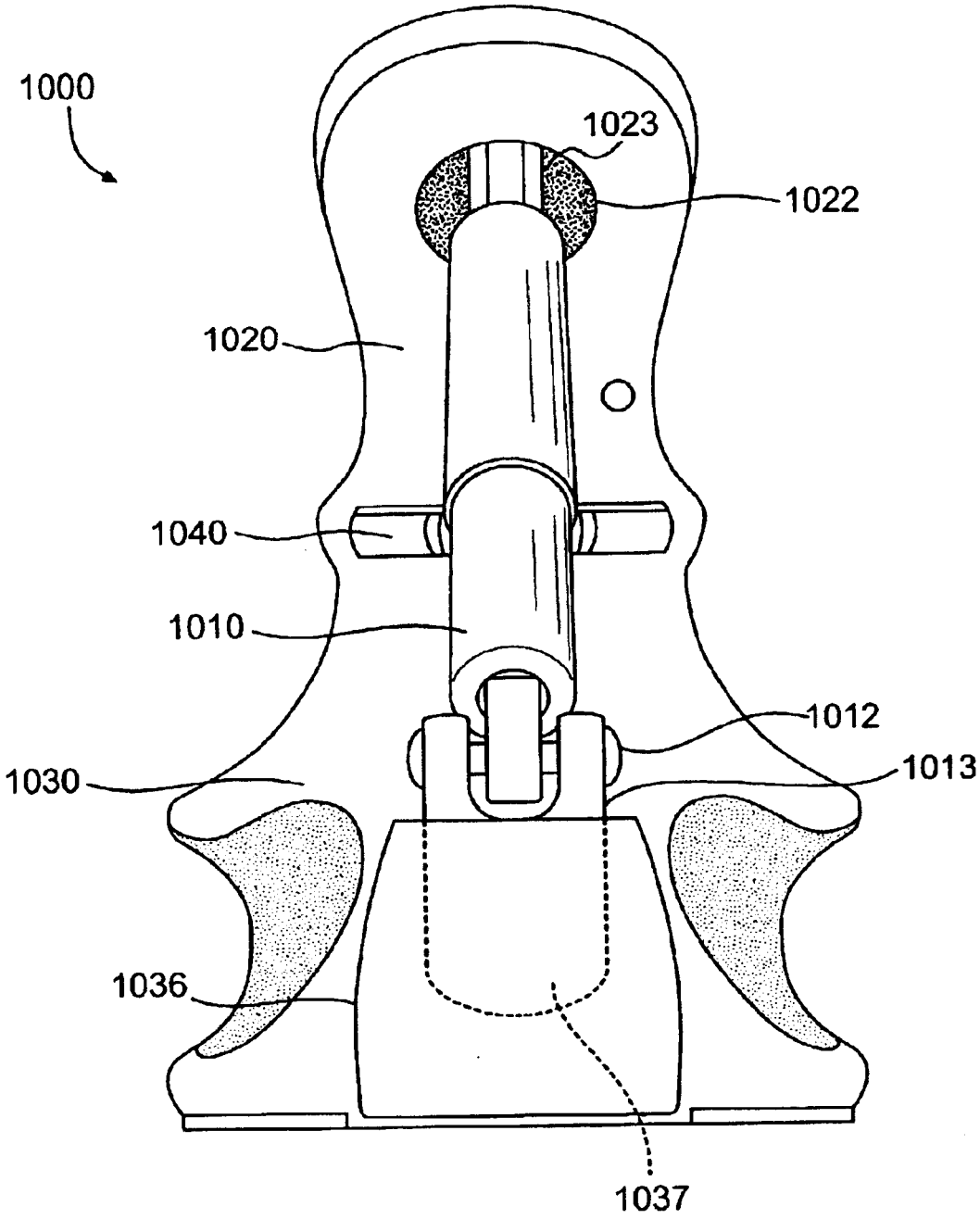
FIG. 10 shows a back view of a dynamic foot support platform according to an exemplary embodiment of the present invention.

FIG. 10 shows another exemplary embodiment of a dynamic foot support platform according to the present invention. A dynamic foot support platform 1000 includes a dampening device 1010, a heel support shelf 1020, and a foot support shelf 1030. Dampening device 1010 is secured to heel support shelf 1020 through connector 1023 in accommodating slot 1022, which configuration is shown in FIG. 10 as a press fit connection. It would be apparent to those skilled in the art that other types of connectors can be used. A rotating pivot 1040 enables relative movement of heel support shelf 1020 with respect to foot support shelf 1030 when a force applied to a top side of foot platform 1000 causes a decrease in length of dampening device 1010, such as during compression.

Dampening device 1010 is secured to a heel area 1036 of foot support shelf 1030 via a connector, which is shown by example in FIG. 10 as a pin 1012 and bracket 1013. It would be apparent to those skilled in the art that other types of connectors can be used. To further increase the strength of the connection between dampening device 1010 and heel area 1036, an internal support structure 1037 is housed inside heel area 1036 that anchors bracket 1013 to heel area 1036. Such a configuration promotes structural stability and the capability of withstanding higher stresses applied to foot platform 1000 without breaking, such as encountered, for example, during rapid walking or running.

Figure 11:
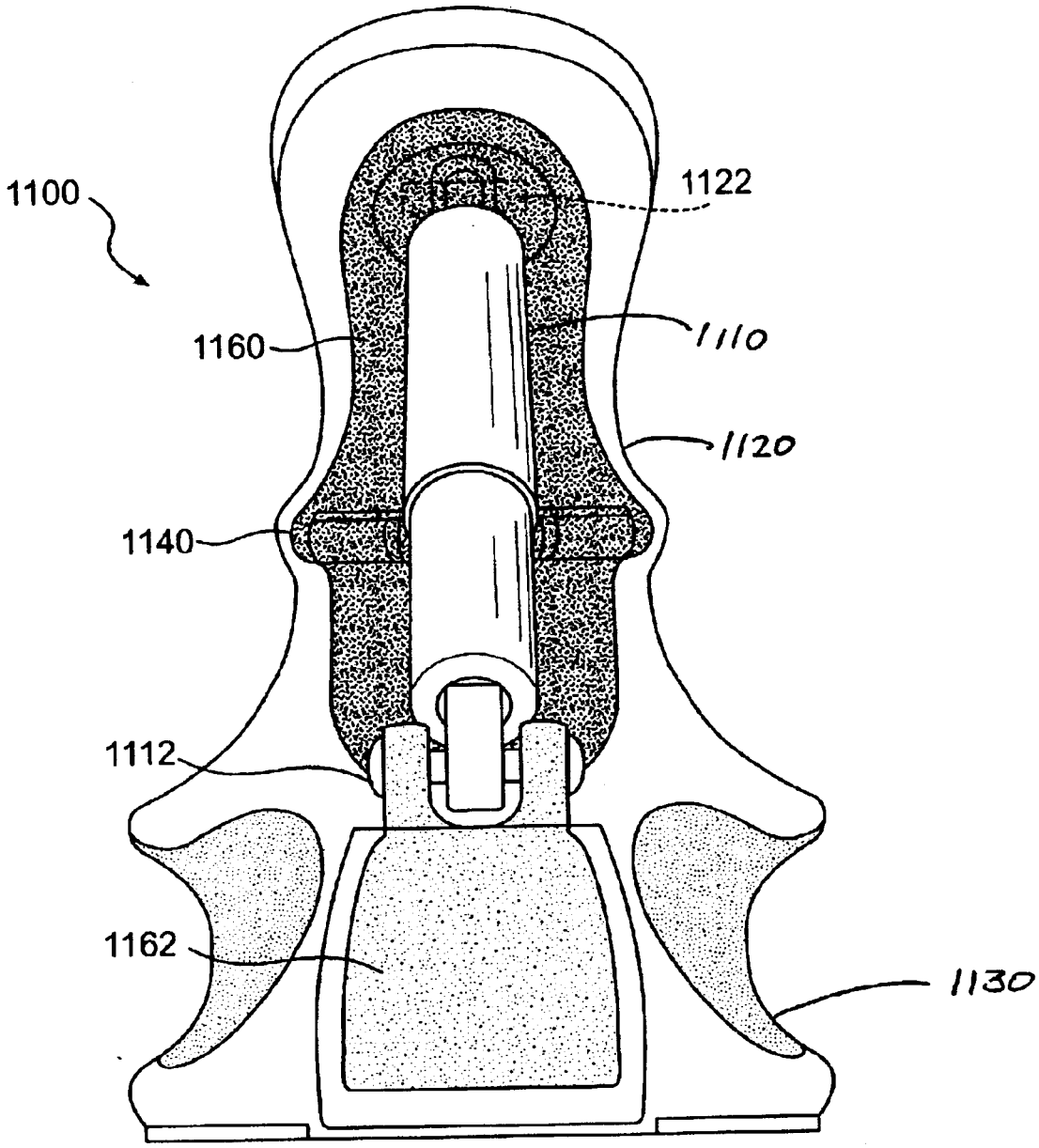
FIG. 11 shows a back view of a dynamic foot support platform according to an exemplary embodiment of the present invention.

FIG. 11 illustrates a dynamic foot support platform according to another embodiment of the present invention. A dynamic foot support platform includes substantially the same general components as dynamic foot support platform 1000, except the optional differences as described in detail herein. A connector 1122, which secures dampening device to heel support shelf has a retaining pin that retains a top protrusion of dampening device. It would be apparent to those skilled in the art that other types of connectors can be used.

A layer of support material 1160 spans the length of heel support shelf 1120 and foot support shelf 1130. Layer 1160 of material may be composed of carbon fiber, hardened plastic, or other suitable material that adds structural stability to dynamic foot support platform 1100 and maintains strength during dynamic motion. Such a layer of support material 1160 may also span across a bottom side of heel support shelf 1120 to protect rotating pivot 1140. Alternatively, such layer of support material 1160 may be positioned within the body of heel support shelf 1120, atop heel support shelf 1120, or combinations thereof. A pin 1112 secures a bottom end of dampening device 1110 to a retaining bracket 1162. Retaining bracket 1162 is a unitary structure with an upper end having slots for retaining pin 1112, and a bottom anchor that is securely fastened within a heel area of foot support shelf. Having a unitary structure retaining bracket 1162 as shown in FIG. 11 as opposed to multiple retaining bracket structure as shown in FIG. 10 decreases the number of parts, the cost, and the complexity of manufacturing.

The above exemplary embodiments of various foot support platforms according to the present invention are shown with a dampening device positioned at a particular angle with respect to a heel support shelf. Furthermore, a single dampening device has been shown in each exemplary embodiment for sake of simplicity. However, other angles and positions of dampening device are also possible, as well as multiple dampening devices. Dampening devices may be positioned in any direction that could benefit from a dampening of forces.

Figure 12:
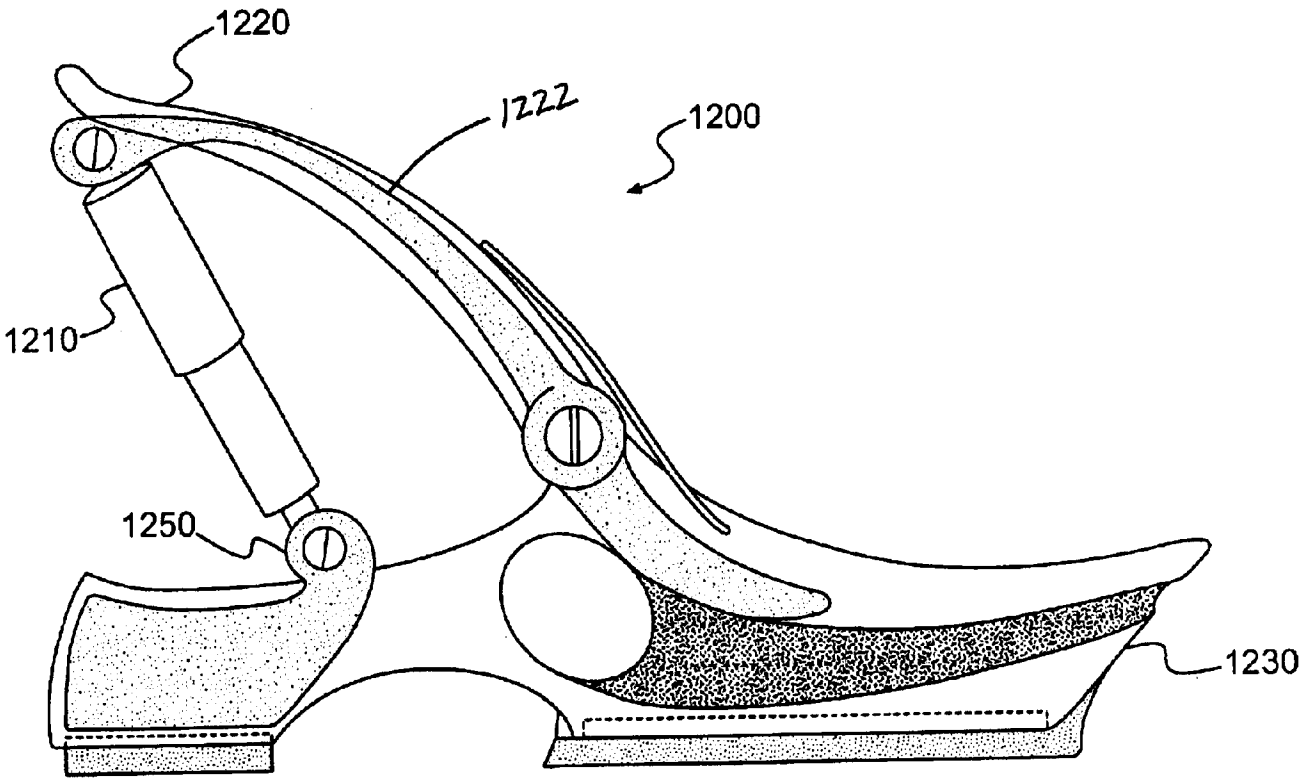
FIG. 12 shows a side view of a dynamic foot support platform according to an exemplary embodiment of the present invention.

FIG. 12 is a diagram illustrating another embodiment of the dynamic foot support platform 1200 according to an embodiment of the present invention. FIG. 12 shows another angle and position of dampening device 1210 in foot support platform 1200. Dampening device 1210 is secured to heel support shelf 1220 using connectors as shown and described in the above exemplary embodiments. However, the bottom end of dampening device 1210 is secured to foot support shelf 1230 using a bracket 1250 that protrudes from a position that is more internal than the exemplary embodiments shown and described above. Such position of bracket 1250 enables dampening device 1210 to have a different angle with respect to other examples shown and described above.

Furthermore, as with other examples described above, an internal support structure 1222 is shown in light shade that extends a length of the body of heel support shelf 1220, from a top portion of dampening device 1210, past rotating pivot, and into foot support shelf 1230. For example, internal support structure 1222 may be a metal support wrapped with a carbon fiber to provide additional structural support to the portions of dynamic foot support platform 1200 that may be in more direct contact with the forces exerted from the bottom side of a foot.

Figure 14B:
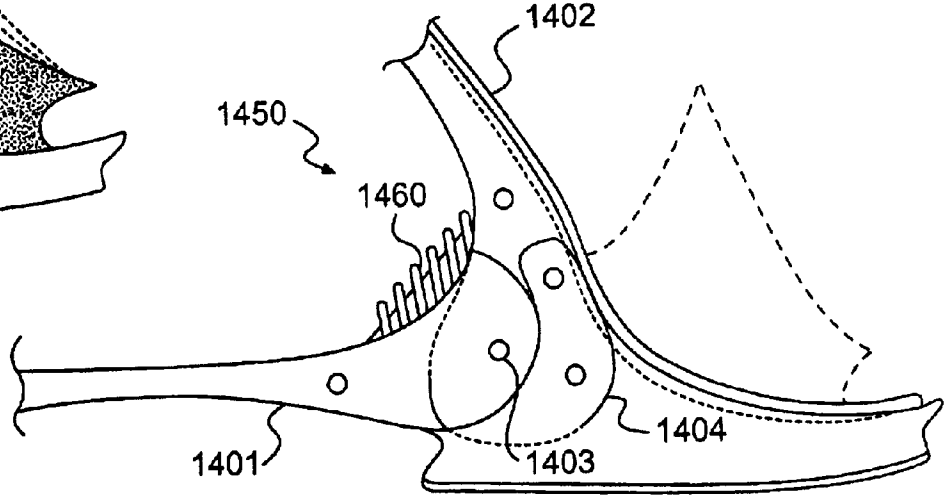
FIG. 14*b* shows an exemplary embodiment of a dynamic foot support platform according to another exemplary embodiment of the present invention.
Figure 14A:
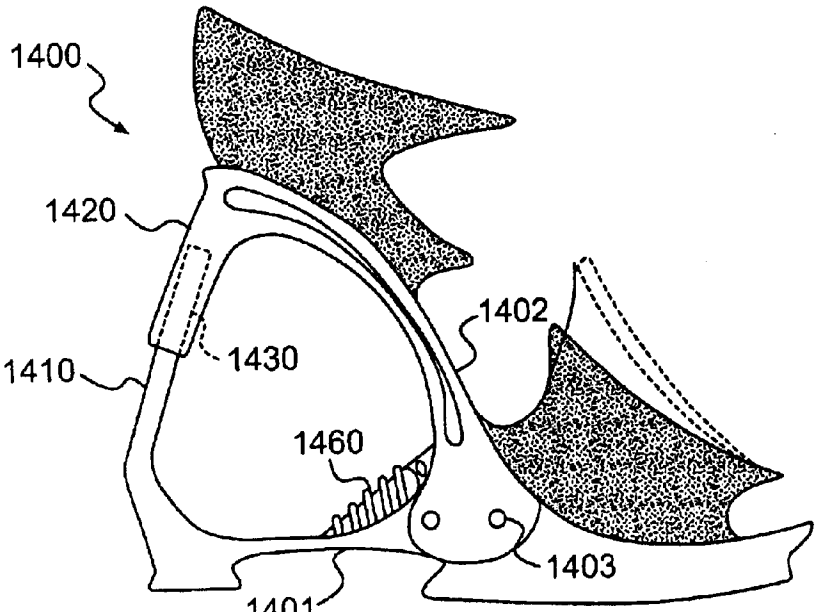
FIG. 14*a* shows an exemplary embodiment of a dynamic foot support platform according to an exemplary embodiment of the present invention.

Other exemplary embodiments of foot platforms according to the present invention are shown in FIGS. 14*a* and 14*b*. In FIG. 14*a*, foot platform 1400 includes a dampening device 1460 positioned very close to a center position of foot platform 1400. Dampening device 1460 is secured between base structure 1401 and heel support shelf 1402. A rod 1410 extends upwards from base structure 1401 at a back end of foot platform 1400. Rod 1410 is slideably engaged with rod accommodating structure 1420 that receives a portion 1430 of rod 1410. When a user is in motion, as when walking, downward forces on heel support shelf 1402 cause a downward movement of heel support shelf 1402 about a pivot point 1403 such that rod 1410 is further inserted into rod accommodating structure 1420, thereby resulting in an increased portion 1430 of rod 1410 positioned within rod accommodating structure 1420.

Foot platform 1450 as shown in FIG. 14*b* is substantially similar to foot platform 1400 shown in FIG. 14*a*, but with the following noted alternative positioning of components. The most external component of pivot point 1403 on foot platform 1400 is heel support shelf 1402. Alternatively, the most external component of pivot point 1403 on foot platform 1450 is base structure 1401. Furthermore, a rotation guide structure 1404 guides proper rotation of base structure 1401 in the exemplary embodiment shown in FIG. 14*b*. Other embodiments are also possible. An advantage of positioning dampening device 1460 very close to pivoting point 1403 is that dampening device 1460 may be hidden from view and therefore not have to be exposed prominently on a given foot platform. Hiding a dampening device may be beneficial from an aesthetic or safety perspective.

The exemplary embodiments shown in FIGS. 14*a* and 14*b* may have alternative relative moving components. In one example, base structure 1401 may be relatively static and heel support shelf 1402 moves in an arc relative to base structure 1401. Alternatively, heel support shelf 1402 may be relatively static and base structure 1401 moves in an arc relative to heel support shelf 1402. Other movement mechanisms are also possible.

The above exemplary embodiments are described having a standard rotating pivot in the form of a rotating pin. However, many different alternatives are also possible as long as they allow for movement of a heel support shelf with respect to a foot platform.

Figure 13A:
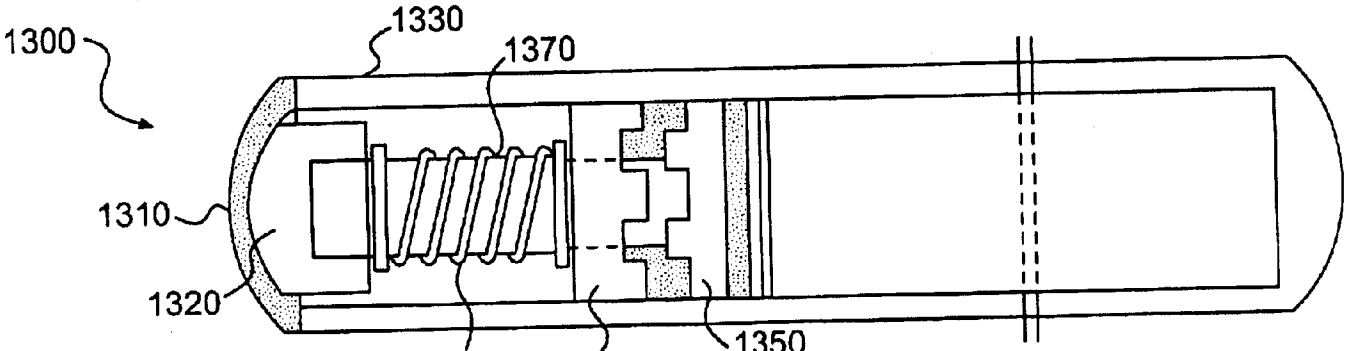
FIG. 13*a* shows a side view of a pivot hinge according to an exemplary embodiment of the present invention.

Another exemplary embodiment of a rotating pivot that may be used with the dynamic foot support platform of the present invention is shown in FIG. 13. Such a pivot may be, for example, a hinge 1300 that includes a mechanism that permits locking of hinge 1300 in various positions. Hinge 1300 has a generally elongated hinge body 1330 that ends in a push button head 1310, which may be rubber or other suitable material. Interior of push button head 1310 is push button actuator 1320 that is connected to a push button shaft 1370. A spring 1360 surrounds push button sliding shaft 1370 and is limited to a space between push button actuator 1320 and a stationary wall 1340, which can be a notch-toothed nut with a hollow core.

Figure 13B:
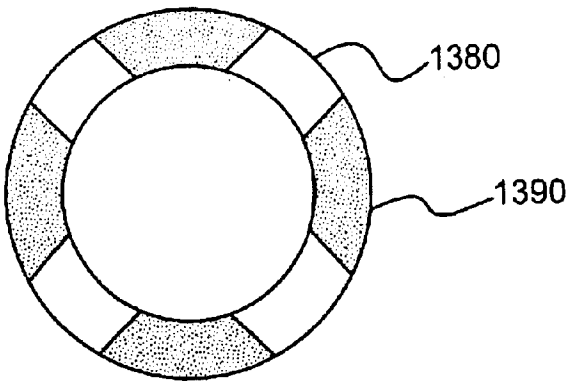
FIG. 13*b* shows a view along a length of the pivot hinge of FIG. 13*a*.

A second wall 1350 accommodates the end of push button sliding shaft 1370 and is designed to mate with stationary wall 1340. Second wall 1350 may be a notched tooth nut. FIG. 13*b* shows a side cut view of the notched areas of walls 1340 and 1350 showing the alternating position of a tooth 1390 and gap accommodating space 1389 that engages a tooth on the mating wall. In use, hinge 1300 enables securing a relative position of a heel support shelf with respect to a foot support shelf, as will be described with respect to FIG. 15.

Figure 15A:
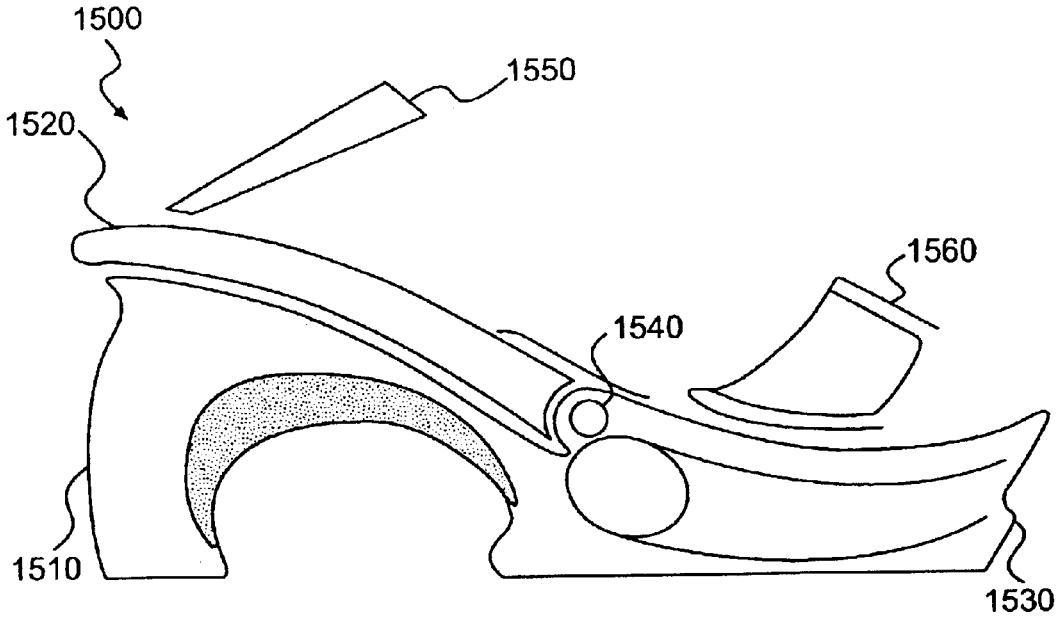
FIG. 15*a* shows an exemplary embodiment of footwear with a dynamic foot support platform according to the present invention.
Figure 15B:
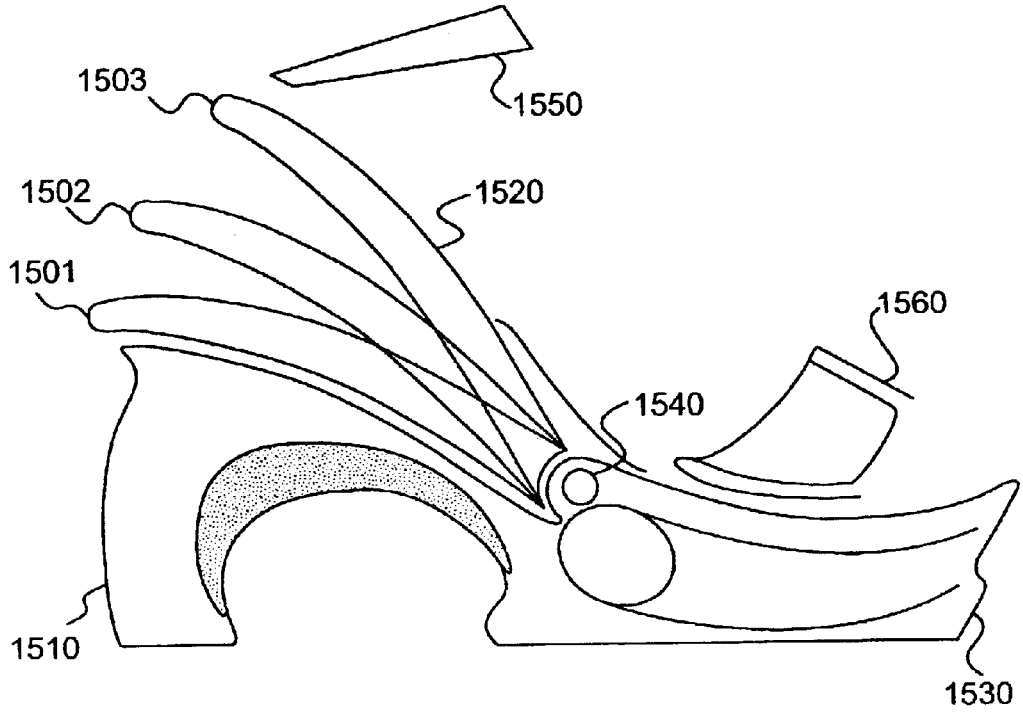
FIG. 15*b* shows an exemplary embodiment of footwear with a dynamic foot support platform according to the present invention with a heel support shelf in various exemplary positions.

In the exemplary embodiment shown in FIG. 15, a shoe 1500 is shown having a heel support shelf 1520, a foot support shelf 1530, and a heel 1510. Rotating pivot 1540 enables heel support shelf 1520 to pivot with respect to the rest of the shoe 1500. A top band 1550 and a bottom band 1560 are used to secure the shoe to a wearer's foot. Heel support shelf 1520 may be in one or more exemplary positions 1501, 1502, 1503, as when a user is walking. A dampening device is not shown in FIG. 15 for sake of clarity. However, such a dampening device may be placed within foot support shelf 1530 and hidden from outside view, similarly to the structure shown in FIG. 14.

Alternatively, shoe 1500 shown in FIG. 15 may not need a dampening device in order to still have range of motion in heel support shelf 1520 as long as rotating pivot 1540 is a hinge such as hinge 1300, shown and described with respect to FIG. 13. If hinge 1300 is used as rotating pivot 1540 in shoe 1500, then the user will have options of the relative position of heel support shelf 1520, such as options 1501, 1502, and 1503. Furthermore, in the exemplary embodiment shown in FIG. 15, a user has the option of adjusting a shoe to be high-heeled, moderate pump, or relatively flat, depending on the desired height of heel support shelf 1520.

However, without a dampening device, shoe 1500 will not have a dynamic reacting mechanism that senses downward stresses and reacts to it through a dampening device to provide reactive upward stresses. It is possible for given footwear to include both a dampening device and a hinge 1300 as shown in FIG. 13. If both such options are used, then a user will still maintain reactive footwear, but one that is adjustable to different levels of full motion. Other options are possible.

Figure 16A:
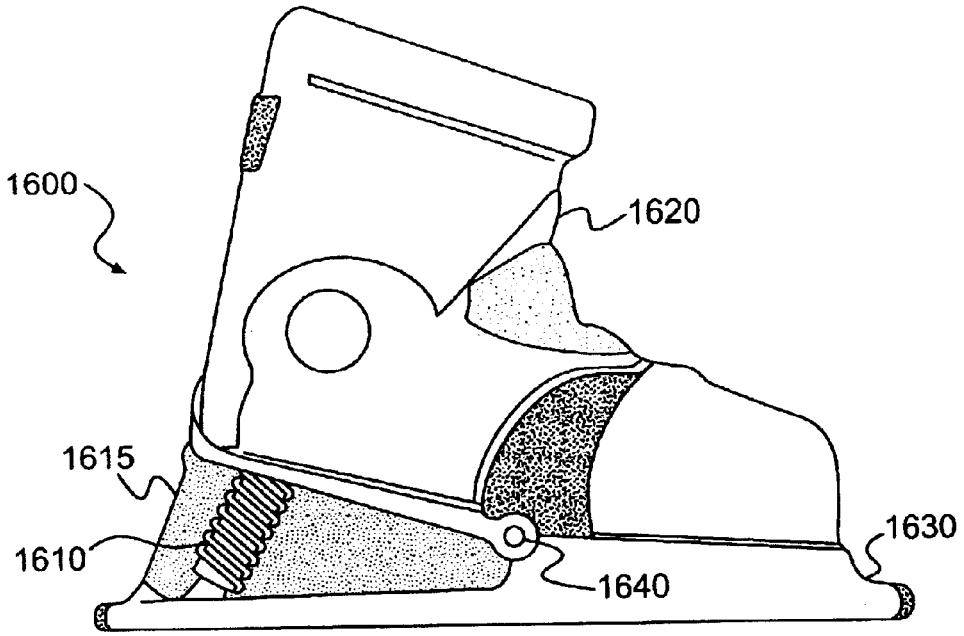
FIG. 16*a* shows an exemplary embodiment of a ski or snowboard boot with a dynamic foot support platform according to the present invention.

Although the above exemplary embodiments of the present invention are generally shown and described using standard footwear, such as shoes and boots, the present invention is not limited to such use and may be used in other footwear. FIG. 16*a* shows an exemplary embodiment of a ski or snow board boot 1600 incorporating a dynamic foot support platform of the present invention as shown and described above. Boot 1600 includes a foot-securing component 1620 that is connected to a dampening device 1610. A locking base 1630 is also connected to the foot-securing component 1620 and the opposite end of dampening device 1610.

In use, as a wearer glides down a mountain slope, various moguls and bumps cause relative upward and downward stresses on the foot strapping component 1620 of boot 1600. These transferred forces are then sensed by dampening device 1610, which then cushions some of the forces and causes reactive stresses that push back upward through the dampening device 1610 and the foot strapping component 1620. In real time motion, foot-securing component 1620 is in a constant upward and downward motion about pivot point 1640, thereby cushioning the stresses normally felt on the bottom side of a wearer's foot. Optionally, a cover 1615 may conceal or protect dampening device 1610 from view and protect it from snow and debris that may decrease its functional life.

Figure 16B:
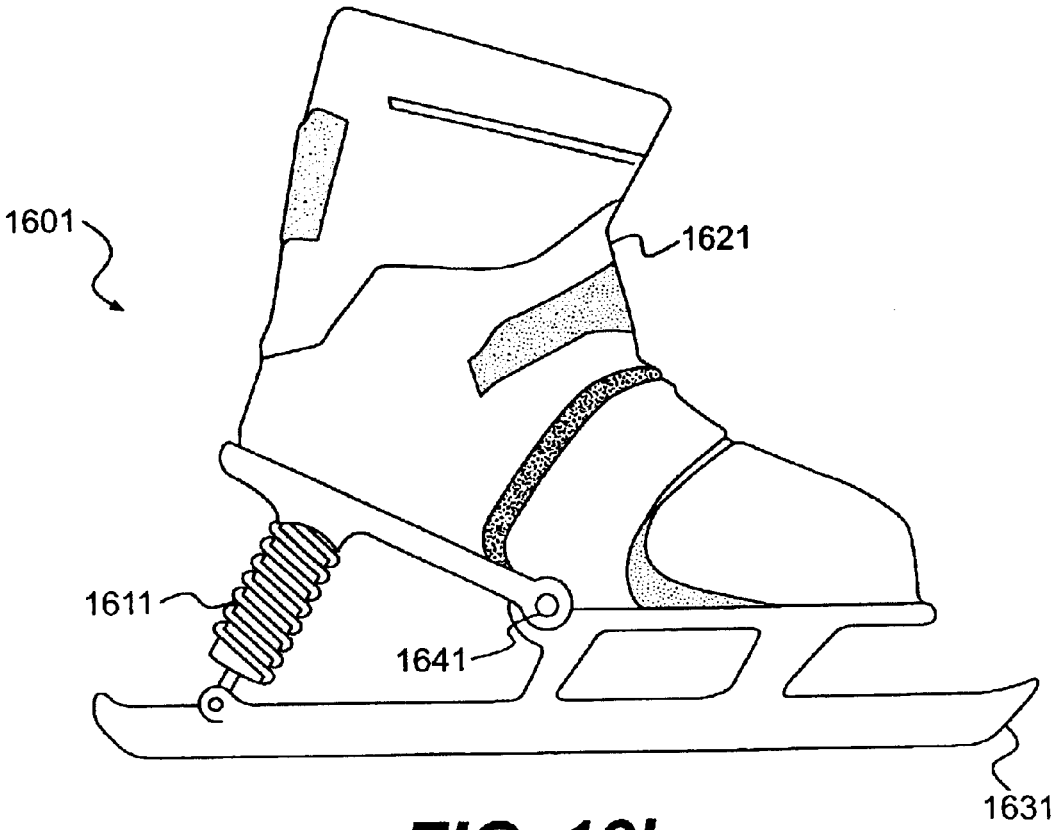
FIG. 16*b* shows an exemplary embodiment of an ice skate with a dynamic foot support platform according to the present invention.

Another exemplary embodiment of footwear having a dynamic foot support platform according to an embodiment of the present invention incorporated within it is an ice skate 1601 shown in FIG. 16*b*. Ice skate 1601 functions in a similar way as described with respect to ski or snow boot 1600 in FIG. 16*a*. Foot-securing component 1621 moves about pivoting point 1641 with respect to blade 1631 by relative length changes of dampening device 1611. For sake of simplicity, ice skate 1600 is shown having a dampening device 1611 that is visible because it has no protective cover 1615. Such a cover 1615 may be secured between foot-securing component 1621 and blade 1631 to protect dampening device 1611 from debris.

Figure 17:
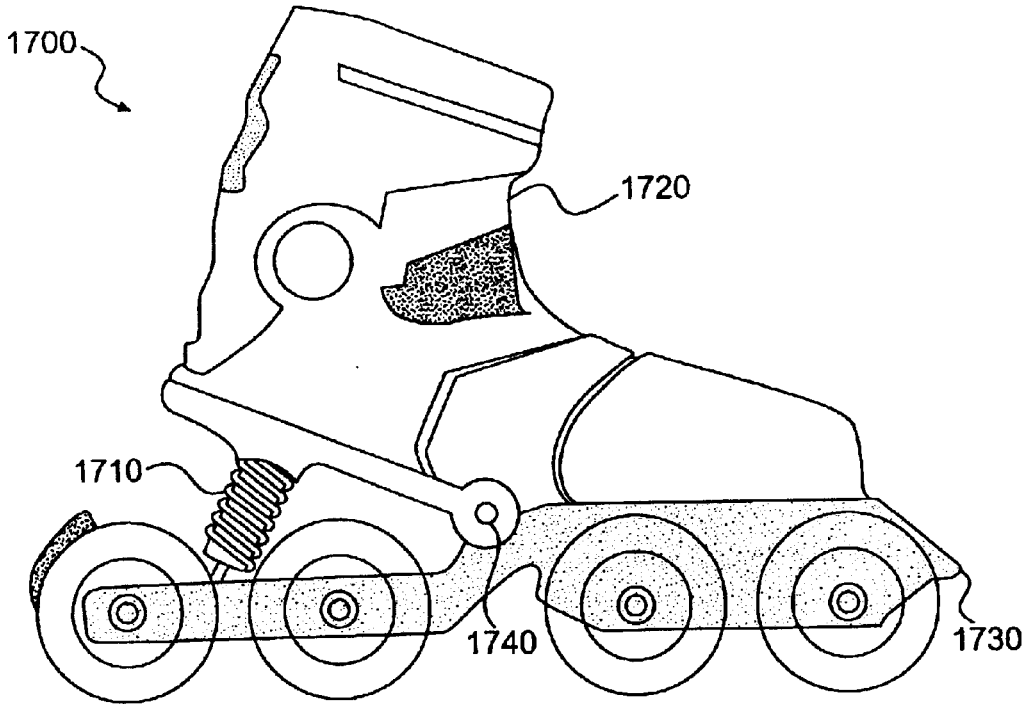
FIG. 17 shows an exemplary embodiment of an inline skate or roller skate with a dynamic foot support platform according to the present invention.

In another exemplary embodiment of footwear incorporating a dynamic foot platform according to an embodiment of the present invention, an inline skate or roller skate 1700 is shown in FIG. 17. Inline skate 1700 has a foot-securing component 1720 that is connected to both a dampening device 1710 and a wheelbase 1730. Dampening device 1710 is also connected to wheelbase 1730. Any relative motion of foot accommodating component 1720 with respect to wheelbase 1730 is possible by rotation about pivot point 1740 caused by changes in the length of dampening device 1710.

There are many advantages in footwear that incorporate the present invention over conventional static footwear. A user wearing footwear having a dynamic foot platform will not expose his or her feet to repeated static forces caused by a hard ground. Another advantage of the present invention is that it allows for motion of the foot itself within the footwear, such that the foot is bent and flexed during natural walking motion, promoting comfort and blood flow. Furthermore, users wearing high heel shoes incorporating foot support platforms according to the present invention will be able to wear such high heel shoes for more extended periods of time without feeling the discomfort typical of high heel shoes. The frequency of broken heels also decreases because the stresses that are created during typical walking or running with shoes having high heels is dampened using a dampening device, therefore resulting in less inconvenience and cost to the wearer from an inopportune broken heel. Finally, an adjustable tension in a dampening device and/or pivoting hinge allows a user to specify the range of motion that is most comfortable in a footwear that incorporates such a dynamic foot support platform. Many other advantages are evident that relate to comfort, safety, and fashion.

Although the above embodiments are described in a specific manner with specific components, the present invention is not limited to such configurations. For example, the above exemplary embodiments are described using a dampening device that appears as a shock absorber, much like those used in a vehicle or bicycles. However, other types of dampening devices are possible. If a shock absorber is used, it may be predetermined to move a limited distance, such as, for example, in a range of 0.75 to 1.00 inches. The shock absorber may be manufactured using a metal that is best suited for its particular use. An exemplary shock absorber that may be used with the present invention may be a conventional shock absorber, but which may have to be altered to fit the present function. Various shock absorbers may be rated for groups of different weight users, such as, for example, "for 110 to 120 pounds". In addition, adjustable shock absorbers can be used to accommodate different wearers or to allow a wearer to "tune" to a comfortable setting. Furthermore, more than one shock absorber may be used in given footwear, such as up to four shock absorbers. Various positions may be selected for each shock absorber, for example, up and down, backward or forward in relation to the footwear, or other suitable positions. Finally, the shock absorber may be air, oil, or spring reinforced. Other types are also possible.

Any footwear as described above, and all of its suitable components, may be manufactured with carbon fiber using conventional manufacturing techniques, such as, injection or vacuum molding. Such processes allow hollow solid shapes to be formed without seams and thickness discrepancies. Furthermore, such processes provide a lightweight and rigid form. Other materials, such as urethane or plastic, may also be used to manufacture such footwear. Urethane or plastic may reduce the amount of tooling and overall production expenses. Use of certain specialized materials, such as urethane, further reduces manufacturing costs while still maintaining structural integrity because the overall number of components and manufacturing steps may be reduced. For example, a uniform body of urethane may be used to manufacture substantially the entire shoe support according to the present invention, including connectors and brackets, and further eliminating the need for structural inserts. Finally, the body portion of footwear that accommodates a dynamic mechanism as described herein may have to endure stretching as a result of such motion without buckling up. Exemplary types of materials that may be used for such body portion may be, for example, leather, rubber, hybrid materials, or other suitable materials.

In describing representative embodiments of the invention, the specification may have presented the method and/or process of the invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the invention should not be limited to the performance of their steps in the order written, and one skilled in the art can readily appreciate that the sequences may be varied and still remain within the spirit and scope of the invention.

The foregoing disclosure of the embodiments of the invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

What I claim is:

1. A dynamic foot support device comprising:

a heel support shelf for supporting a heel portion of a foot, said heel support shelf having a bottom surface and extending from the heel portion of the foot to an arch portion of the foot;

a foot support shelf for supporting a bottom portion of a foot, said foot support shelf having a top surface and extending from the heel portion of the foot to a toe portion of the foot; and a tubular dampening device having two ends and an internal longitudinal axis along its length and positioned in between and in communication with the bottom surface of the heel support shelf and the top surface of the foot support shelf through a detachable connector at each end; wherein the longitudinal axis is not parallel to the foot support shelf and wherein the tubular dampening device allows a relative motion of the heel support shelf with respect to the foot support shelf when a force is applied to the heel support shelf.

2. The device of claim 1, further comprising:

a pivoting joint connecting the heel support shelf and the foot support shelf, wherein the relative motion of the heel support shelf with respect to the foot support shelf occurs in an arc about the pivoting joint.

3. The device of claim 2, further comprising:

a layer of protective material positioned on the pivoting joint, wherein the layer of protective material protects a foot from motion of the pivoting joint.

4. The device of claim 1, further comprising:

an internal support layer located inside the heel support shelf, wherein the internal support layer provides structural support to the heel support shelf.

5. The device of claim 1, wherein the relative motion of the heel support shelf may be adjusted with respect to the foot support shelf.

6. The device of claim 1, wherein the connector comprises a metal pin.

7. The device of claim 1, wherein the connector comprises a press fit connector.

8. A dynamic foot support device comprising:

a heel support shelf for supporting a heel portion of a foot, said heel support shelf having a bottom surface and extending from the heel portion of the foot to a portion of the foot that is before a toe portion;

a foot support shelf for supporting a bottom portion of a foot, said foot support shelf having a top surface and extending from the heel portion of the foot to the toe portion of the foot; and a tubular dampening device having two ends and an internal longitudinal axis along its length and in communication with the heel support shelf and the foot support shelf via connectors at each end; wherein the dampening device allows a relative motion of the heel support shelf with respect to the foot support shelf when a force is applied to the heel support shelf.

9. A dynamic foot support device comprising:

a heel support shelf for supporting a heel portion of a foot, said heel support shelf extending from the heel portion of the foot to a second portion of the foot located before a toe portion;

a foot support shelf for supporting a foot, said foot support shelf extending from the heel portion of the foot to the toe portion of the foot; and a dampening device in communication with the heel support shelf and the foot support shelf; wherein the dampening device includes a piston having two ends and that extends directly between and connects to the heel support shelf and the foot support shelf via connectors at each end and that allows a relative motion of the heel support shelf with respect to the foot support shelf when a force is applied to the heel support shelf.

* * * * *